US010041460B2

(12) United States Patent
Rehwald et al.

(10) Patent No.: US 10,041,460 B2
(45) Date of Patent: Aug. 7, 2018

(54) SYSTEM HAVING A FUEL DISTRIBUTOR AND MULTIPLE FUEL INJECTORS

(71) Applicant: Robert Bosch GmbH, Stuttgart (DE)

(72) Inventors: Andreas Rehwald, Bietigheim-Bissingen (DE); Matthias Maess, Boeblingen (DE); Goekhan Guengoer, Eberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 611 days.

(21) Appl. No.: 14/397,309

(22) PCT Filed: Mar. 27, 2013

(86) PCT No.: PCT/EP2013/056582
§ 371 (c)(1),
(2) Date: Oct. 27, 2014

(87) PCT Pub. No.: WO2013/160064
PCT Pub. Date: Oct. 31, 2013

(65) Prior Publication Data

US 2015/0068497 A1 Mar. 12, 2015

(30) Foreign Application Priority Data

Apr. 26, 2012 (DE) ..... 10 2012 206 896

(51) Int. Cl.
*F02M 61/14* (2006.01)
*F02M 63/02* (2006.01)
*F02M 61/20* (2006.01)

(52) U.S. Cl.
CPC ..... *F02M 63/0225* (2013.01); *F02M 61/14* (2013.01); *F02M 61/20* (2013.01);
(Continued)

(58) Field of Classification Search
CPC .... F02M 63/0225; F02M 61/20; F02M 61/14; F02M 2200/853; F02M 2200/855;
(Continued)

(56) References Cited

U.S. PATENT DOCUMENTS 5,111,794 A * 5/1992 DeGrace, Jr. ..... F02M 51/005 123/456
5,680,845 A * 10/1997 Peng ..... F02M 61/145 123/470

(Continued)

FOREIGN PATENT DOCUMENTS

CN 101135286 A 3/2008
DE 102008044165 A1 6/2010

(Continued)

OTHER PUBLICATIONS

International Search Report for PCT/EP2013/056582, dated Jul. 12, 2013.

*Primary Examiner* — David Hamaoui
(74) *Attorney, Agent, or Firm* — Norton Rose Fulbright US LLP; Gerard Messina

(57) ABSTRACT

A system, which in particular is used as a fuel injection system for high-pressure injection in internal combustion engines, includes a fuel distributor and a plurality of fuel injectors. Each of the fuel injectors is situated on a cup of the fuel distributor. At least one of the fuel injectors is fastened to the associated cup by a retaining clip. The retaining clip has at least one clip section which is situated between an inner side of the cup and an outer side of the fuel injector. Furthermore, at least one damping composite element is provided, which is situated between the clip section of the retaining clip and the outer side of the fuel injector. The damping composite element has an elastically deformable
(Continued)

damping layer. A decoupling is thus realized, which acts to damp vibrations and consequently to reduce noise.

17 Claims, 4 Drawing Sheets

(52) U.S. Cl.
CPC ... *F02M 2200/09* (2013.01); *F02M 2200/803* (2013.01); *F02M 2200/8023* (2013.01); *F02M 2200/853* (2013.01); *F02M 2200/855* (2013.01)

(58) Field of Classification Search
CPC ..... F02M 2200/8023; F02M 2200/803; F02M 2200/09
See application file for complete search history.

(56) References Cited

U.S. PATENT DOCUMENTS 6,032,651 A * 3/2000 Field ..... F02M 37/0041 123/467
6,543,421 B2 * 4/2003 Lorraine ..... F02M 55/005 123/470
6,684,861 B2 * 2/2004 Reiter ..... F02M 69/465 123/456
6,866,026 B2 * 3/2005 Mickelson ..... F02M 61/14 123/470
6,899,087 B2 * 5/2005 Norgauer ..... F02M 61/14 123/467
7,334,571 B1 * 2/2008 Beardmore ..... F02M 61/14 123/456
7,765,984 B2 * 8/2010 Fuerst ..... F02M 55/025 123/456
9,347,411 B2 * 5/2016 Friedrich ..... F02M 55/004
9,528,485 B2 * 12/2016 Serra ..... F02M 55/025
9,541,047 B2 * 1/2017 Pohlmann ..... F02M 61/14
2009/0071445 A1 * 3/2009 Mueller ..... F02M 61/14 123/470
2009/0235898 A1 * 9/2009 Short ..... F02M 53/046 123/470
2010/0012093 A1 1/2010 Pepperine et al.
2010/0071664 A1 3/2010 Hunt et al.
2010/0258085 A1 * 10/2010 Giorgetti ..... F02M 55/02 123/470
2015/0083082 A1 * 3/2015 Pohlmann ..... F02M 61/14 123/445
2015/0345445 A1 * 12/2015 Reinhardt ..... F02M 61/14 239/584

FOREIGN PATENT DOCUMENTS

EP 0102164 3/1984
EP 2034171 3/2009
EP 2101097 9/2009
EP 2151572 2/2010
GB 2051951 A 1/1981

* cited by examiner

SYSTEM HAVING A FUEL DISTRIBUTOR AND MULTIPLE FUEL INJECTORS

FIELD OF THE INVENTION

The present invention relates to a system, especially a fuel injection system, for the high-pressure injection for internal combustion engines, having a fuel distributor and multiple fuel injectors. In particular, the present invention pertains to the field of fuel-injection systems for mixture-compressing internal combustion engine featuring external ignition, in which fuel is injected directly into the combustion chambers.

BACKGROUND INFORMATION

A fuel distributor rail and multiple fuel injectors disposed on the fuel distributor rail are known from the European Published Patent Application No. 2 151 572. A collar-shaped element having tabs on both sides is placed around an upper fuel intake connector for connecting the fuel injectors to the fuel distributor rail. In addition, a retaining clip is provided, which engages around a cylindrical body of an injector connection from above, along a longitudinal axis, the tabs of the collar engaging with openings of the retaining clip. This results in a fastening of the fuel injector at the cylindrical body of the injector connection.

The design known from the European Published Patent Application No. 2 151 572 has the disadvantage that the fuel distributor rail can be excited to vibrations in the audible frequency range during operation. This happens especially by noise sources in the fuel injectors. The structure-borne noise, for example, spreads from the fuel injectors via the injector connections, the fuel distributor rail and the rail holder, possibly also to the add-on structure, from where interfering noise is radiated. These interfering noises may possibly even reach the interior of the vehicle. The add-on structure on which the fuel distributor rail is fastened may be the cylinder head, for example.

SUMMARY

The system according to the present invention has the advantage of ensuring improved vibrational damping. Specifically, the advantage results that vibrations that arise in the region of the fuel injectors, in particular, with reference to a transmission to the fuel distributor, are able to be effectively damped and that interfering noise is reduced.

The system is especially suitable for internal combustion engines having direct gasoline injection. In this case, the fuel distributor may be designed in particular as a fuel manifold. The fuel distributor is used for storing fuel under high pressure and for distributing the fuel among the fuel injectors, especially high pressure fuel injectors. The fuel injectors inject the fuel required for the combustion process into the respective combustion chamber under high pressure. For this purpose, the fuel is compressed by a high-pressure pump and conveyed in controlled quantities into the fuel distributor via a high-pressure line.

The system may advantageously be designed as a fuel injection system. The fuel distributor may be connected to an add-on structure in a suitable manner. The add-on structure may be the cylinder head of the internal combustion engine. However, a connection via spacer sleeves or via additional connection elements is possible as well.

The fuel injectors may be suspended at the cups, so to speak. In particular, cardan mounting on the cups is possible.

The retaining clip may be developed as U-shaped retaining clip, in particular. Quasi-static forces for the fastening are transmittable via the retaining clip. In so doing, it is also ensured that the relative deflection of the fuel injectors with respect to the cups under the effect of operating forces remains under a defined limit value, in order to protect sealing elements such as an O-ring seal from wear.

In addition, a vibration-related decoupling and damping is achieved, between the fuel injectors and the fuel distributor, by the damping composite element, while the other requirements continue to be ensured.

Preferably, the fastening via a retaining clip and an associated damping composite element is provided for each fuel injector.

The damping composite element is advantageously situated between the retainer section of the retaining clip and the outside of the fuel injector. In this context it is furthermore advantageous that a recess is developed on the inside of the cup, in which the retaining section of the retaining clip is inserted. In this way, a form-fitting connection between the clip section and the cup is achieved in the installed state in the direction of a longitudinal axis of the fuel injector. Instead of a direct placement of the fuel injector at the clip section of the retaining clip, an indirect placement via the damping composite element is implemented. Vibrations that arise during operation are damped thereby. The fuel injector may be excited to vibrations in particular due to the rapidly repeating actuation. A transmission of these vibrations to the cup is damped by the damping composite element. Damping of the vibrations transmitted to the fuel distributor thus takes place, and it is possible to achieve a reduction in noise.

Furthermore, it is advantageous that a supporting surface is developed on the outer side of the fuel injector, which is inclined in relation to the longitudinal axis of the fuel injector in an axial cross-section, that a first outer side of the damping composite element cooperates with the support surface at the first outer side of the fuel injector, and that a second outer side of the damping composite element that is facing away from the first outer side cooperates with the clip section of the retaining clip. Moreover, it is advantageous that the outer side of the fuel injector has a conical design, and the first outer side of the damping composite element is resting against the conical outer side of the fuel injector. The damping composite element may have a flat or rectangular profile. This achieves the greatest large-area contact of the damping composite element at the outer side of the fuel injector. It allows a more even loading of the damping layer, which results in an excellent damping effect. In addition, it is advantageously possible to specify the position of the damping element relative to the fuel injector. This simplifies the assembly, and the damping effect remains ensured over the service life. A compensation for tolerances with respect to the retaining clip is thereby ensured as well.

However, it is also advantageous that the clip section of the retaining clip has an elliptical or circular cross-section, and the second outer side of the damping composite element rests at least partially against the clip section. In this way the position of the damping composite element in relation to the clip section is able to be specified. During operation, this prevents shifting of the damping composite element relative to the clip section of the retaining clip. In addition, pointwise or linear loading, and thus surface pressure, between the damping composite element and the retaining clip is avoided. Furthermore, this makes it possible to compensate for tolerances for the positioning of the fuel injector relative to the retaining clip and the damping composite element.

It is advantageous that a mechanical force transmission always takes place via the mechanical fastening between the fuel injector and the associated cup via the damping layer of the damping composite element. This achieves effective damping, and direct contact of metal on metal, for example, is prevented in particular.

It is also advantageous that the damping composite element has at least one metal layer that is joined to the damping layer. The damping layer may be produced from a visco-elastic material, for example. The metal layer may be made from sheet metal. The damping layer is able to be joined to the metal layer in a suitable manner. Preferably, the damping layer is directly connected to the metal layer. A connection with the aid of vulcanization is possible in this context. It is advantageous for this purpose that the damping layer is based on a rubber material. The term rubber should be taken quite generally in this case, and besides natural rubber also includes synthetic rubber materials.

Because of the use of the damping composite element at the interface between the cup and the fuel injector, decoupling or isolation of the noise sources existing at the fuel injector is achieved with respect to the fuel distributor. As a result, fewer structure-borne noise components are thereby transmitted from the fuel distributor into a cylinder head or a possibly provided other add-on structure. As a result of these two effects, the sound radiation and the sound transmission of the system to the engine are reduced.

It is also advantageous that at least one damping layer is designed as an outer-lying damping layer. The outer-lying damping layer may lie directly against the fuel injector or directly against the clip section of the retaining clip, in this case. An embodiment of the damping composite element having two outer-lying damping layers, which form the first outer side and the second outer side of the damping composite element is also possible.

It is also advantageous that at least one additional metal layer is provided, and that at least one damping layer is situated between the metal layer and the additional metal layer. In this connection, an embodiment having a plurality of damping layers is also possible. Because of the situation of a damping layer between two metal layers, the advantageous protection is possible of this damping layer from the environment and from mechanical abrasion.

Furthermore, it is advantageous that the damping composite element is designed as a partially annular damping composite element, that the damping composite element has end sections and an arched section connecting the end sections, and that the damping composite element is designed to have a greater width at its end sections than at its arched section. Consequently, because of the end sections, wide contact areas may be ensured, at which effective damping is achieved. By contrast, the arched section makes possible great flexibility of the damping composite element, since it is designed to be comparatively narrow. Thus, especially in combination with a U-shaped retaining clip, damping over the wide end section may be achieved at the two clip sections of the retaining clip, while the narrow arched section of the damping composite element enables a tolerance adjustment.

DETAILED DESCRIPTION

Figure 1:
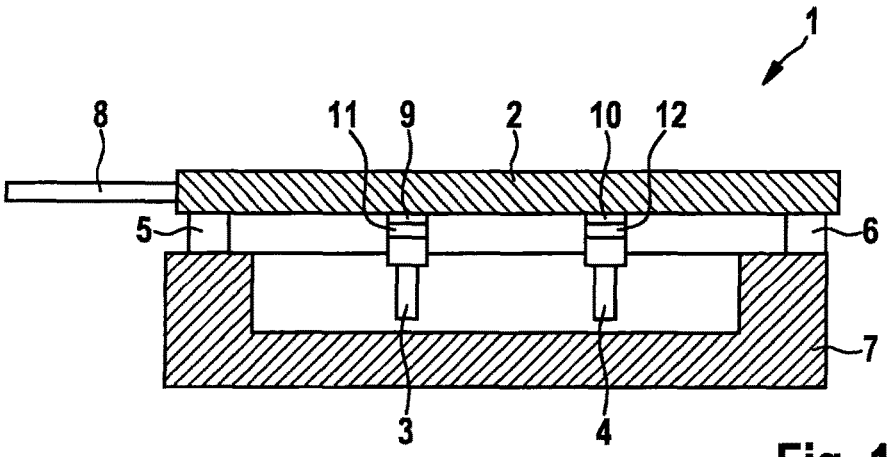
FIG. 1 a system having a fuel distributor and a plurality of fuel injectors in a schematic sectional representation corresponding to a first exemplary embodiment of the present invention.

FIG. 1 shows a system 1 having a fuel distributor 2 and a plurality of fuel injectors 3, 4 in a schematic sectional representation. System 1 may be particularly designed as a fuel-injection system for high-pressure injection in internal combustion engines. Fuel distributor 2 may be fastened to an add-on structure 7, particularly to a cylinder head 7, at specified screw-on points via retainers 5, 6. To simplify the illustration, only two fuel injectors 3, 4 are shown in FIG. 1. A larger number of fuel injectors may also be provided, however. In this exemplary embodiment, fuel distributor 2 is designed as a fuel distributor rail 2, having an elongated, particularly tube-shaped base body. A high-pressure line 8 is connected to fuel distributor 2, via which, during operation, fuel at high pressure is guided into fuel distributor 2.

Fuel distributor 2 has a plurality of cups 9, 10. Fuel injector 3 is situated at cup 9. Fuel injector 4 is situated at cup 10. Fuel injectors 3, 4 are not directly connected to cups 9, 10 of fuel distributor 2, but only indirectly. The mechanical force transmission takes place, in this case, using a damping composite element 11, 12, respectively. The force transmission path is schematically illustrated in FIG. 1. The constructive design of the connection between fuel distributor 2 and fuel injectors 3, 4 corresponding to the first exemplary embodiment is shown in greater detail below, with the aid of FIG. 2.

Figure 2:
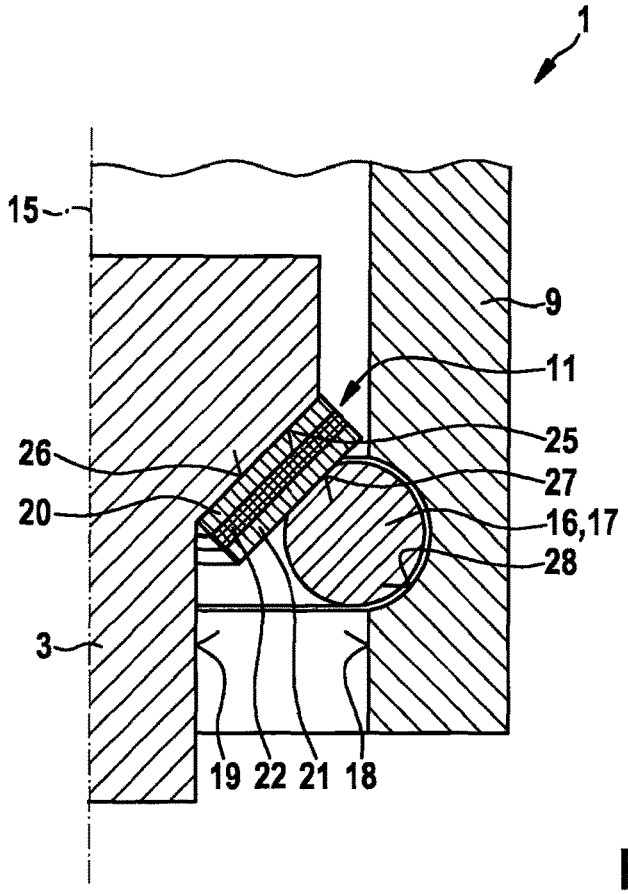
FIG. 2 a schematic sectional representation, in excerpted form, of the system shown in FIG. 1, corresponding to the first exemplary embodiment of the present invention.

FIG. 2 shows in excerpted form a schematic section of system 1 shown in FIG. 1, corresponding to the first exemplary embodiment. In this instance, fuel injector 3 is partially inserted into cup 9. Longitudinal axis 15 of fuel injector 3 preferably extends centrically through cup 9. For the fastening of fuel injector 3 to cup 9, in the inserted state, a retaining clip 16 is mounted on cup 9. In the mounted state, clip section 17 of retaining clip 16 is then located between an inner side 18 of cup 9 and, without directly making contact, to an outer side 19 of fuel injector 3. Furthermore, damping composite element 11 is situated between clip section 16 and outer side 19 of fuel injector 3.

In this exemplary embodiment, damping composite element 11 has metal layers 20, 21 and a damping layer 22. Damping layer 22 is situated between metal layers 20, 21, in this instance. Damping layer 22 may be connected to metal layers 20, 21, in this context. In this embodiment, damping layer 22 is advantageously protected from the environment and from abrasion. In addition, an advantageous force transmission comes about. The transmitted forces are especially able to be homogenized, and point-shaped or lineshaped peak loads are avoided. This ensures an advantageous damping behavior over the whole service life.

On outer side 19 of fuel injector 3, there is a supporting area 25. Supporting area 25 is inclined with respect to longitudinal axis 15 of fuel injector 3 in an axial cross section. In particular, supporting area 25 may be designed as a conical supporting area 25. Damping composite element 11 has a first outer side 26 and a second outer side 27, which face away from each other. First outer side 26 of damping composite element 11 cooperates with supporting area 25 of outer side 19 of fuel injector 3. In this instance, damping composite element 11 lies with its first outer side 26 flat against supporting area 25 of fuel injector 3. An advantageous force transmission is ensured. In addition, a local positioning of damping composite element 11 relative to fuel injector 3 is ensured. Second outer side 27 of damping composite element 11 cooperates with clip section 17 of retaining clip 16. Clip section 17 of retaining clip 16 has an at least approximately circular cross section. The cross section of clip section 17 may also be designed to be approximately elliptical. On inner side 18 of cup 9, a recess 28 is embodied into which clip section 17 of retaining clip 16 is inserted. Thereby retaining clip 16 is fixed relative to cup 9. Using damping composite element 11, fuel injector 3 is thus also fixed with respect to cup 9.

The fastening of fuel injector 3 to fuel distributor 2 is thus ensured. Vibrations generated particularly by operating fuel injector 3 are thereby damped on the transmission path to cup 9, by damping composite element 11. An effective noise reduction is thus possible.

Figure 3:
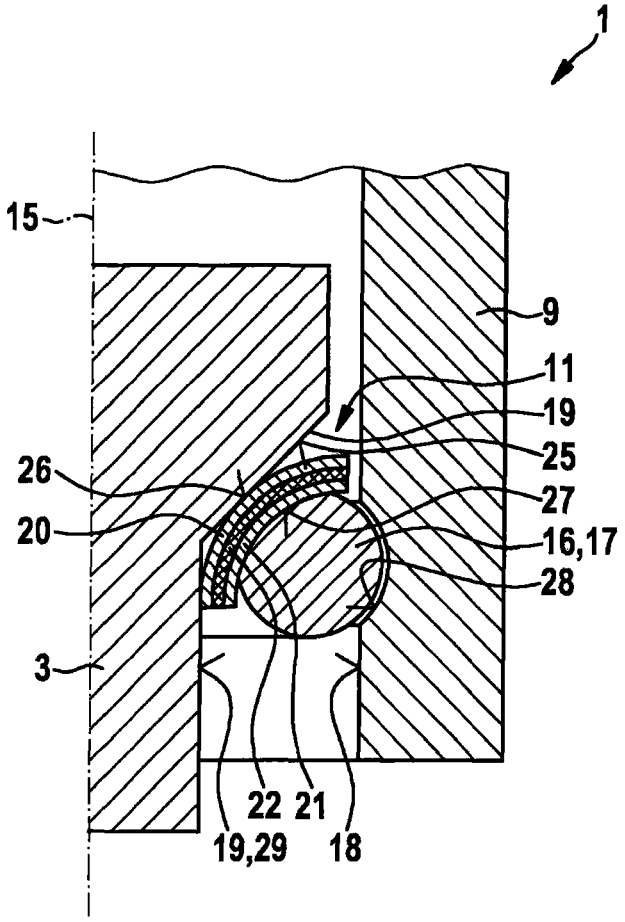
FIG. 3 the cutout shown in FIG. 2 corresponding to a second exemplary embodiment of the present invention.

FIG. 3 shows the cutout of device 1 shown in FIG. 2, having fuel injector 3, cup 9 of fuel distributor 2, retaining clip 16 and damping composite element 11, according to a second exemplary embodiment. In this exemplary embodiment, damping composite element 11 is situated between clip section 17 of retaining clip 16 and outer side 19 of fuel injector 3 in such a way that damping composite element 11 is supported partially on supporting area 25 and partially on a cylinder sleeve-shaped part 29 of outer side 19. In this connection, damping composite element 11 is designed to be bent, as seen in profile. For, second outer side 27 of damping composite element 11 lies at least partially against clip section 17 of retaining clip 16.

Because of the positioning of damping composite element 11, as described, for example, with the aid of FIGS. 2 and 3, it is ensured that a mechanical force transmission takes place via the mechanical fastening between fuel injector 3 and associated cup 9 of fuel distributor 2 always via damping layer 22 of damping composite element 11 Vibrations are therefore reliably damped by damping layer 22. A corresponding embodiment is provided for fuel injector 4 and its associated cup 10. Thus, preferably, for each of fuel injectors 3, 4 of system 1, such a fastening to an associated damping composite element 11, 12 is provided.

Figure 4:
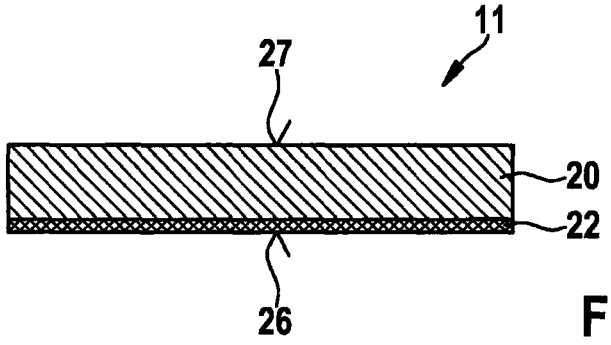
FIG. 4 a damping composite element shown in FIG. 2, in a schematic sectional view, corresponding to a third exemplary embodiment of the present invention.

FIG. 4 shows damping composite element 11 shown in FIG. 2, in a schematic sectional view, corresponding to a third exemplary embodiment. In this exemplary embodiment, damping composite element 11 is made up of a metal layer 20 and a damping layer 22. Damping layer 22 may be connected to metal layer 20, in this context. For example, first outer side 26 of damping composite element 11 may be provided on damping layer 22, while second outer side 27 is provided on metal layer 20. Then damping layer 22 lies against supporting area 25 of outer side 19 of fuel injector 3. However, an opposite embodiment or positioning is also possible. Moreover, damping composite element 11 may also be designed to be bent, as is illustrated in FIG. 3.

Figure 5:
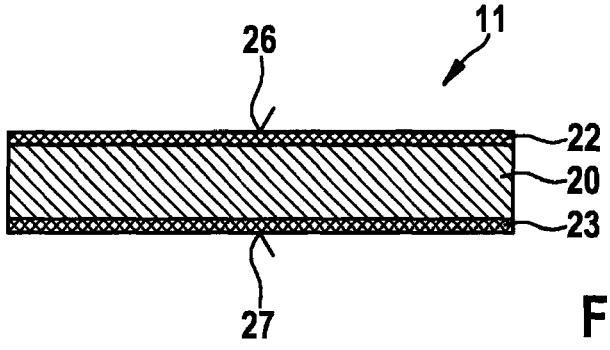
FIG. 5 the damping composite element shown in FIG. 4, in a schematic sectional view, corresponding to a fourth exemplary embodiment of the present invention.

FIG. 5 shows damping composite element 11 shown in FIG. 4, in a schematic sectional view, corresponding to a fourth exemplary embodiment. In this exemplary embodiment, damping composite element 11 has a metal layer 20, and a damping layers 22, 23. First outer side 26 of damping composite element 11 is developed on damping layer 22. Second outer side 27 is developed on damping layer 23. In the case of this embodiment, damping layers 22, 23 thus lie on the outside, while metal layer 20 lies inside. Consequently, within certain limits, an adjustment to the contact partner is possible, namely, on the one hand, fuel injector 3 and, on the other hand, retaining clip 16.

Figure 6:
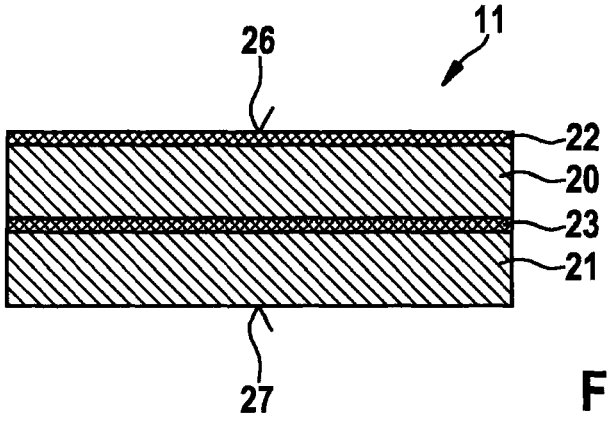
FIG. 6 the damping composite element shown in FIG. 4, in a schematic sectional view, corresponding to a fifth exemplary embodiment of the present invention.

FIG. 6 shows damping composite element 11 shown in FIG. 4, in a schematic sectional view, corresponding to a fifth exemplary embodiment. In this exemplary embodiment, damping composite element 11 is made up of two metal layers 20, 21 and two damping layers 22, 23. Damping layer 23 is situated between metal layers 20, 21. Metal layer 20 is situated between damping layers 22, 23. Damping layer 22 is used as outer-lying damping layer 22, while damping layer 23 is used as inner-lying damping layer 23. Metal layer 21 is used as outer-lying metal layer 21, while metal layer 20 is used as inner-lying metal layer 20. First outer side 26 may be developed on damping layer 22, for example. Second outer side 27 is developed on metal layer 21, in that case. However, an opposite embodiment is also possible.

It should be noted that damping composite elements 11, which are shown in FIGS. 4 to 6, are shown in profile, as is also the case in FIGS. 2 and 3. Starting from this profile, numerous modifications are conceivable. In particular, bending or the design of bending edges at one or more places and/or about one or more axes are possible. A further adjustment of the geometry of damping composite element 11 is described in greater detail with the aid of FIG. 7.

Figure 7:
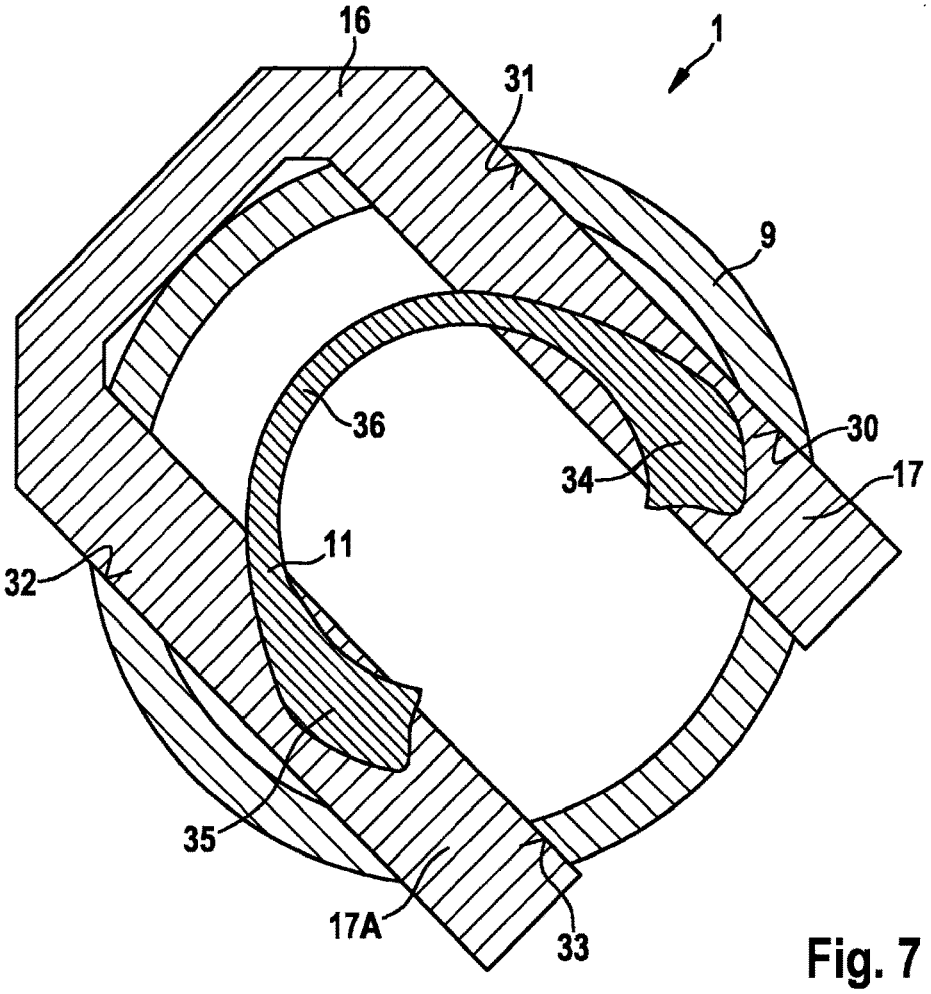
FIG. 7 a cup, a retaining clip and a damping composite element of the system shown in FIG. 1, in an excerpted, schematic sectional view, corresponding to a sixth exemplary embodiment of the present invention.

FIG. 7 shows cup 9, retaining clip 16 and damping composite element 11 of a system 1 in an excerpted, schematic sectional representation corresponding to a sixth exemplary embodiment. To simplify the illustration in this case, associated fuel injector 3 is not shown. Retaining clip 16 is designed as a U-shaped retaining clip 16. Retaining clip 16 has clip sections 17, 17A. Cup 9 has suitable recesses 30, 31, 32, 33, through which retaining clip 16 is able to be pushed into cup 9, so to speak. Recesses 30 to 33 may be implemented by borings, for example. The two clip sections 17, 17A are preferably oriented in parallel to each other.

Damping composite element 11 is embodied as a partially annular damping composite element 11, in this exemplary embodiment. In this connection, damping composite element 11 has end sections 34, 35. In addition, damping composite element 11 has an arched section 36, which connects end sections 34, 35 to each other. At its end sections 34, 35, damping composite element 11 is designed to have a greater width than at its arched section 36. End sections 34, 35 are thus designed as broadened end sections 34, 35, which form wider contact areas 34, 35 for fuel injector 3, on the one hand, and clip sections 17, 17A on the other hand. Arched section 36, in comparison to this, forms a narrow arched section 36 as a connecting part (spine).

Consequently, a damping composite element 11 may be selected in a design adapted to the respective application case. In this instance, one or more metal layers 20, 21 and one or more damping layers 22, 23 are provided. In addition, an annular or partially annular embodiment may be used. Damping layers 22, 23 may be designed as viscoelastic damping layers 22, 23. Damping layers 22, 23 may preferably be designed as thin viscoelastic damping layers 22, 23.

In a relative displacement of metal layers 20, 21 and/or neighboring components, namely retaining clip 16 and fuel injector 3, with respect to one another, damping layer 22, 23, lying respectively between them, are dynamically greatly stressed, so that a large proportion of vibrational energy is dissipated by the material damping. In this context, damping layer 22, 23 may especially be formed of an elastomer.

The dissipation of structure-borne noise energy thus leads to a damping of vibrational forms of fuel injectors 3, 4 and fuel distributor 2, and with that, to a reduction in all structure-borne noise proportions which are transmitted by this layer. This property makes possible a decoupling, or rather an insulation between fuel injectors 3, 4 and fuel distributor 2. Pure metal contacts, via which a structure-borne noise transmission would be possible, may thus be prevented from the outset. For the mechanical forces are constantly transmitted via a damping layer 22, 23.

The properties of damping layer 22, 23, such as a thickness or material-specific properties may be adapted with respect to some optimization parameters. Optimization parameters, in this instance, are above all frequency contents that are to be damped and temperature, especially the operating temperature.

Consequently, substantial advantages may be achieved. The noises of fuel distributor 2 are reduced. A relatively rigid connection of fuel injectors 3, 4 may be maintained in spite of the decoupling. For the resilience of fuel injectors 3, 4 only increases slightly, whereas all functional requirements, particularly a slight relative motion and solidity requirements, particularly the wear of a sealing O-ring are satisfied. Consequently, acoustical, functional and solidity requirements, which come about from the design of fuel injectors 3, 4 and fuel distributor 2, may be satisfied.

The noise damping may advantageously be implemented by the fixing using retaining clips 16.

By one advantageous execution in sheet metal, radial and/or contour adjustments on cups 9, 10 and on fuel injectors 3, 4 may be performed, in order to prevent line contact. Damping layers 22, 23 may be firmly vulcanized in, as elastomer layers 22, 23 between metal layers 20, 21, and thus be protected from abrasion.

The mounting effort is slight, since damping composite elements 11, 12 only have to be laid in before the mounting of fuel injectors 3, 4.

The decoupling is able to be implemented in a line-bound design of fuel injector 2, in that damping composite elements 11, 12 are used at the joining location between suspended fuel injectors 3, 4 and a functional block for fuel distributor 2.

The present invention is not limited to the exemplary embodiments described.

What is claimed is:

1. A system, comprising:

a fuel distributor;

a plurality of fuel injectors, each of the fuel injectors being situated on a cup of the fuel distributor and at least one of the fuel injectors being fastened by a retaining clip to the associated cup, wherein the retaining clip has at least one clip section situated between an inner side of the cup and an outer side of the fuel injector, the clip section having in a plane parallel to a longitudinal axis of the fuel injector at least one of: an at least approximately elliptical cross section, or an at least approximately circular cross section; and at least one damping composite element situated between the clip section of the retaining clip and the outer side of the fuel injector, wherein the damping composite element has at least one elastically deformable damping layer and an outer side lying at least partially against the clip section.

2. The system as recited in claim 1, wherein the system is a fuel injection system for high-pressure injection in an internal combustion engine.

3. The system as recited in claim 1, wherein on the inner side of the cup, a recess is embodied into which the clip section of the retaining clip is inserted.

4. The system as recited in claim 1, wherein:

on the outer side of the fuel injector a supporting area is disposed, the supporting area being inclined in relation to a longitudinal axis of the fuel injector in an axial cross-section, a first outer side of the damping composite element cooperates with the supporting area at the outer side of the fuel injector, and a second outer side of the damping composite element faces away from the first outer side and cooperates with the clip section of the retaining clip.

5. The system as recited in claim 4, wherein:

the supporting area is conical, and the first outer side of the damping composite element at least essentially lies against the conical supporting area of the fuel injector.

6. The system as recited in claim 4, wherein:

at least the clip section of the retaining clip has one of an at least approximately elliptical cross section and an at least approximately circular cross section, and the second outer side of the damping composite element lies at least partially against the clip section.

7. The system as recited in claim 1, wherein a mechanical force transmission via the mechanical fastening between the fuel injector and the associated cup always takes place via the damping layer of the damping composite element.

8. The system as recited in claim 1, wherein the damping composite element has at least one metal layer connected to the damping layer.

9. The system as recited in claim 8, wherein the damping layer is embodied as an outer-lying damping layer.

10. The system as recited in claim 8, further comprising at least one additional metal layer, wherein the damping layer is situated between the metal layer and the additional metal layer.

11. The system as recited in claim 1, wherein the damping composite includes a partially annular damping composite element, and wherein the damping composite element has end sections and an arched section connecting the end sections.

12. The system as recited in claim 11, wherein at the end sections, the damping composite element has a greater width than at the arched section.

13. The system as recited in claim 1, wherein the clip section has a curved surface contacting the outer side of the damping composite element.

14. The system as recited in claim 1, wherein a second outer side of the damping composite element lies at least partially against both a supporting area of the fuel injector inclined relative to the longitudinal axis and an outer side of the fuel injector substantially parallel to the longitudinal axis.

15. The system as recited in claim 1, wherein the damping composite element includes a first metal layer lying at least partially against a portion of the fuel injector.

16. The system as recited in claim 15, wherein the damping composite element includes a second metal layer lying at least partially against a portion of the clip section.

17. The system as recited in claim 16, wherein the at least one elastically deformable damping layer lies between the first metal layer and the second metal layer.

* * * * *